US008245603B2

(12) United States Patent
Piper et al.

(10) Patent No.: US 8,245,603 B2
(45) Date of Patent: Aug. 21, 2012

(54) DRIVER WITH TAPERED HEX SOCKET

(75) Inventors: Arthur Anton Piper, Loves Park, IL (US); Kevin B. Tews, North Aurora, IL (US)

(73) Assignee: Textron Innovations Inc., Providence, RI (US)

( * ) Notice: Subject to any disclaimer, the term of this patent is extended or adjusted under 35 U.S.C. 154(b) by 360 days.

(21) Appl. No.: 12/633,224

(22) Filed: Dec. 8, 2009

(65) Prior Publication Data

US 2010/0154602 A1 Jun. 24, 2010

Related U.S. Application Data

(60) Provisional application No. 61/121,000, filed on Dec. 9, 2008.

(51) Int. Cl.
*B25B 13/06* (2006.01)
*B25B 23/08* (2006.01)

(52) U.S. Cl. ..... 81/121.1; 81/186

(58) Field of Classification Search ..... 81/121.1, 81/125, 186, 53.2

See application file for complete search history.

(56) References Cited

U.S. PATENT DOCUMENTS

| | | | | |
|---|---|---|---|---|
| 1,321,776 | A * | 11/1919 | Stepanian | 81/124.2 |
| 1,590,200 | A | 6/1926 | McGuckin | |
| 3,495,485 | A | 2/1970 | Knudsen et al. | |
| 4,126,063 | A | 11/1978 | Palmer | |
| 4,503,737 | A | 3/1985 | DiGiovanni | |
| 5,163,345 | A | 11/1992 | Doan et al. | |
| 5,277,531 | A | 1/1994 | Krivec | |
| 5,361,657 | A * | 11/1994 | Terry | 81/186 |
| 5,544,555 | A | 8/1996 | Corley et al. | |
| 5,682,801 | A * | 11/1997 | Waechter | 81/121.1 |
| 6,003,411 | A | 12/1999 | Knox et al. | |
| 6,045,311 | A | 4/2000 | Chang | |
| 6,626,067 | B1 | 9/2003 | Iwinski et al. | |
| 6,840,139 | B2 * | 1/2005 | Haylock | 81/121.1 |
| 7,437,975 | B1 | 10/2008 | De Anfrasio | |
| 2006/0236822 | A1 * | 10/2006 | Nish | 81/125 |
| 2008/0016988 | A1 * | 1/2008 | Leighton | 81/121.1 |
| 2008/0271577 | A1 * | 11/2008 | Kochling | 81/121.1 |

FOREIGN PATENT DOCUMENTS

| | | |
|---|---|---|
| EP | 1 025 959 | 8/2000 |

OTHER PUBLICATIONS

European Search Report completed on Feb. 17, 2010; Seven (7) pages.

* cited by examiner

*Primary Examiner* — David B Thomas
(74) *Attorney, Agent, or Firm* — Clark Hill PLC

(57) ABSTRACT

A driver is used to manually drive a fastening member. The driver includes a shank, a handle provided at an end thereof, and a socket provided at the opposite end thereof. The socket has a receptacle which includes a front portion extending from a front face of the socket a predetermined distance and a tapered portion extending from the front portion a predetermined distance. The front portion is larger than the outer dimension of the fastening member and is formed from walls which are parallel to the centerline of the socket. The tapered portion tapers inwardly from the front portion toward the centerline. The tapered portion extends uninterrupted 360° around the receptacle such that a rear edge of the fastening member continuously contacts the tapered portion when inserted therein.

20 Claims, 3 Drawing Sheets

DRIVER WITH TAPERED HEX SOCKET

This application claims the domestic benefit of U.S. Provisional Application Ser. No. 61/121,000 filed on Dec. 9, 2008, which disclosure is hereby incorporated by reference in its entirety.

FIELD OF THE INVENTION

The present invention relates to a driver for rotatably driving a threaded fastening member, such as nuts, screws and the like.

BACKGROUND OF THE INVENTION

U.S. Pat. No. 5,163,345 discloses a nut driver with a tubular shank having a socket coupled to one end thereof for receiving an associated rotatable fastener, such as a nut. The nut driver has an elongated hollow tubular shank, an elongated handle attached to one end of the shank and a socket attached to the other end of the shank. The shank has a cylindrical external surface, and a cylindrical internal surface which defines a bore formed axially through the shank. The elongated handle has a blind bore formed axially therein at one end thereof. In use, the inner end of the tubular shank is received into the blind bore in the handle and fixed thereto by suitable means. The socket is a generally cylindrical member having an axial bore provided therethrough with an enlarged-diameter counterbore portion at the inner end thereof, which is dimensioned for receiving therein the outer end of the shank. The socket is fixedly secured to the shank. The bore of the socket is provided with a receptacle for mateably receiving the rotatable fastener. The receptacle defines an annular shoulder at the inner end thereof against which one of the faces of the rotatable fastener seats in use. A helical compression spring is mounted in the bore of the shank and has an outer end that is coupled to a magnetic assembly, which is known in the art. The magnetic assembly bears against the inner face of the rotatable fastener to magnetically retain the rotatable fastener in the receptacle. In operation, when the rotatable fastener is driven onto the shank of an associated bolt, the tip of the bolt shank engages the magnetic assembly and compresses the spring for thereby accommodating the shank of the bolt in the shank of the nut driver. Thus, the rotatable fastener may be driven for a considerable distance onto the shank of the associated bolt.

The magnetic assembly is costly to manufacture since it requires so many components that must be made and assembled. In addition, the magnetic assembly tends to collect metallic debris that can clog the socket making insertion of a nut difficult.

U.S. Pat. No. 6,045,311 discloses a nut driver for use with a tapered nut. The nut has a tapered, polygonal nut body, an axial coupling hole defined within the nut body, and an inner thread provided on the inside of the nut body around the axial coupling hole. The nut body has a tapered, polygonal outside wall axially inwardly sloping from a front end thereof toward a rear end thereof. The driver has a socket integral with one end of a shaft thereof. The socket has a tapered, polygonal coupling hole for coupling to the tapered, polygonal nut body of the nut, permitting the nut to be turned with the driver. The coupling hole tapers from the front end of the socket to the rear end of the socket. The driver in U.S. Pat. No. 6,045,311 uses a taper lock. The nut and the driver both have the identical slight taper. Because both the nut and socket are tapered, the "lock" is so severe that the lock makes removal of the nut from the socket extremely difficult.

The present invention provides a driver for rotatably driving a threaded fastening member which overcomes the problems presented in the prior art and which provides additional advantages over the prior art, such advantages will become clear upon a reading of the attached specification in combination with a study of the drawings.

SUMMARY OF THE INVENTION

Briefly, the present invention discloses a driver for manually driving a fastening member. The driver includes an elongated shank, a handle provided at an end thereof, and a socket provided at the opposite end thereof. The socket has a receptacle therein for receiving the fastening member. The receptacle includes a front portion extending from a front face of the socket rearwardly a predetermined distance and a tapered portion extending from a rear of the front portion a predetermined distance. The front portion has a dimension which is greater than the outer dimension of the fastening member and is formed from a plurality of walls which are parallel to the centerline of the socket. The tapered portion tapers inwardly from the front portion toward a centerline of the socket such that the largest dimension of the tapered portion is joined with the front portion and the smallest dimension of the tapered portion is spaced from the front portion. The tapered portion extends uninterrupted 360° around the receptacle such that a rear edge of the fastening member continuously contacts the tapered portion when inserted therein.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
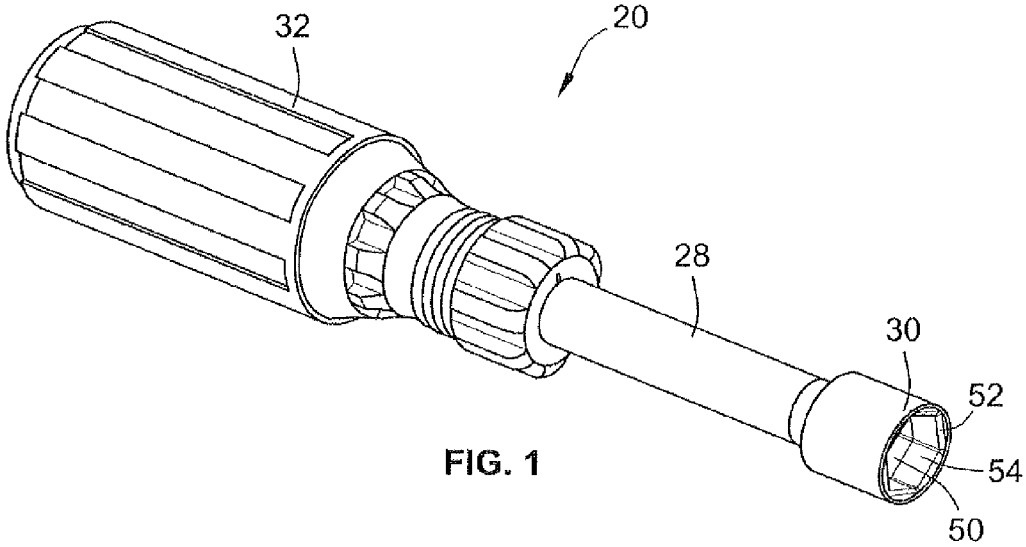
FIG. 1 is a perspective view of a driver for rotatably driving a threaded fastening member which incorporates the features of the present invention.
Figure 2:
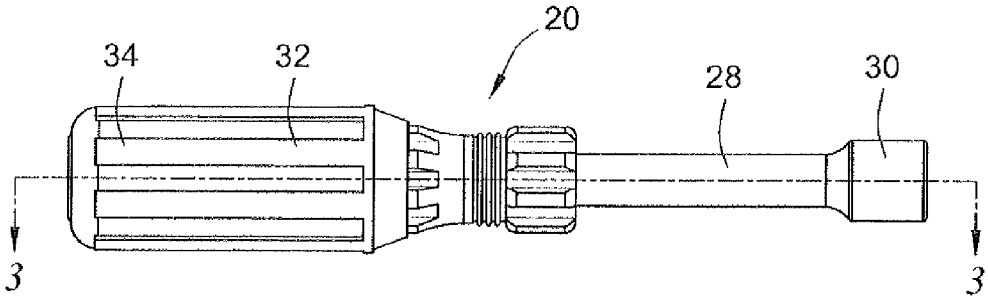
FIG. 2 is a side elevational view of the driver.
Figure 3:
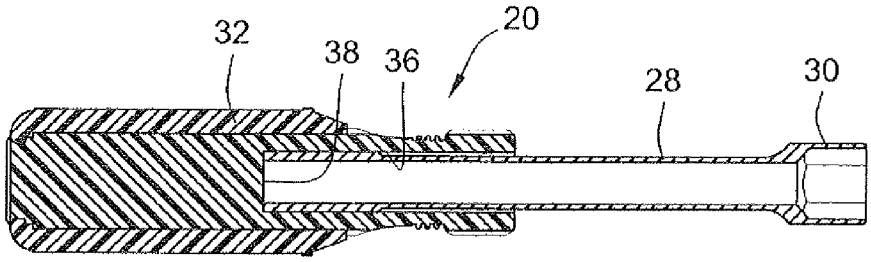
FIG. 3 is a cross-sectional view of the driver along line 3-3 of FIG. 2.
Figure 4:
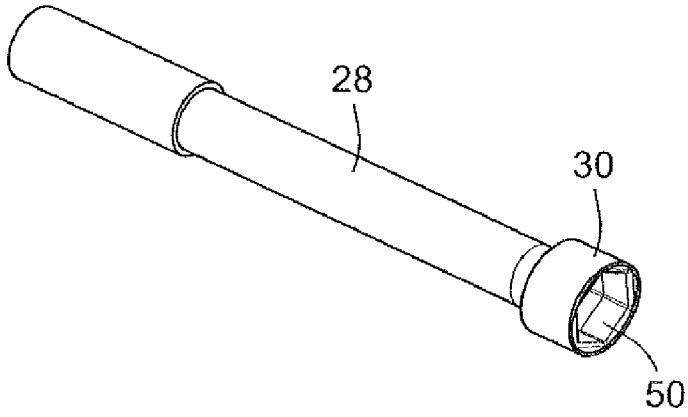
FIG. 4 is a perspective view of an elongated shank which forms part of the driver.
Figure 5:
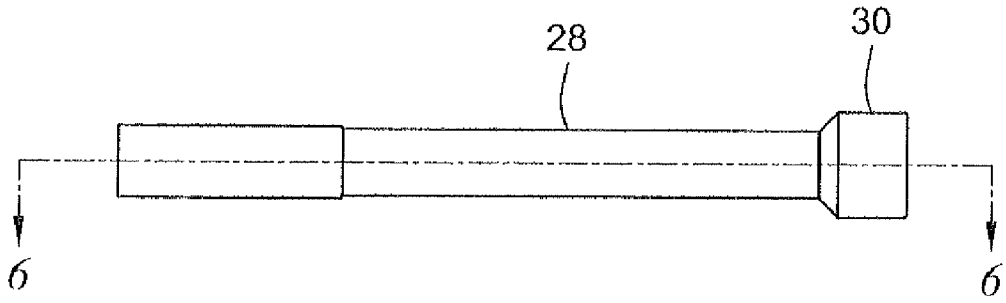
FIG. 5 is a side elevational view of the elongated shank.
Figure 6:
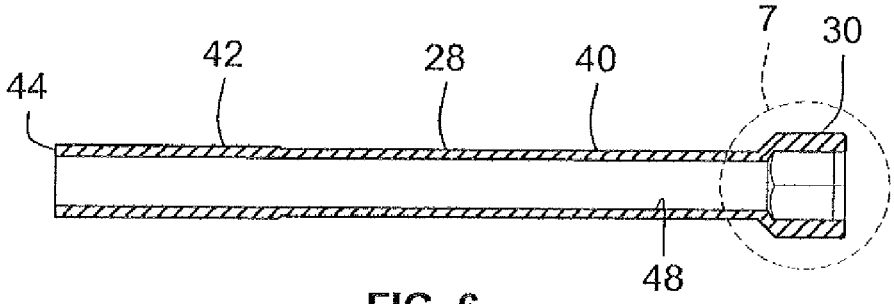
FIG. 6 is a cross-sectional view of the elongated shank along line 5-5 of FIG. 5.
Figure 7:
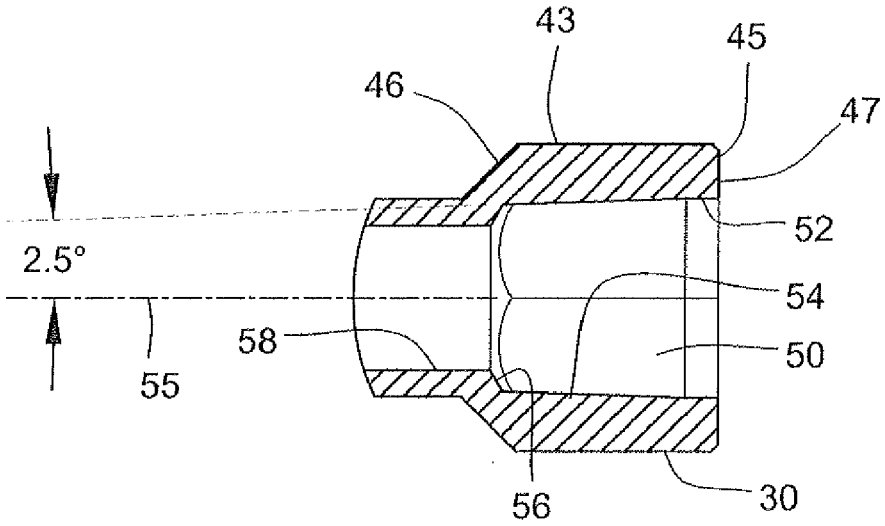
FIG. 7 is an enlarged partial cross-sectional view of the elongated shank.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 8:
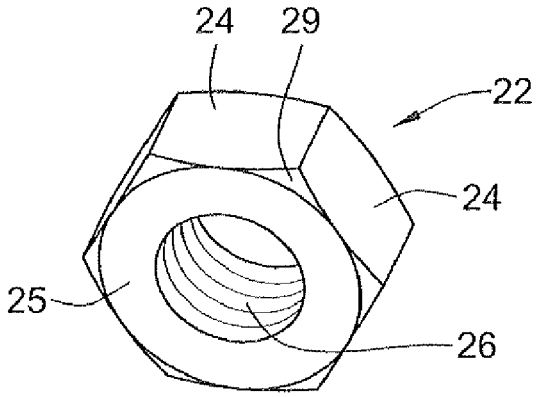
FIG. 8 is a perspective view of a conventional fastening member that is used with the driver.
Figure 9:
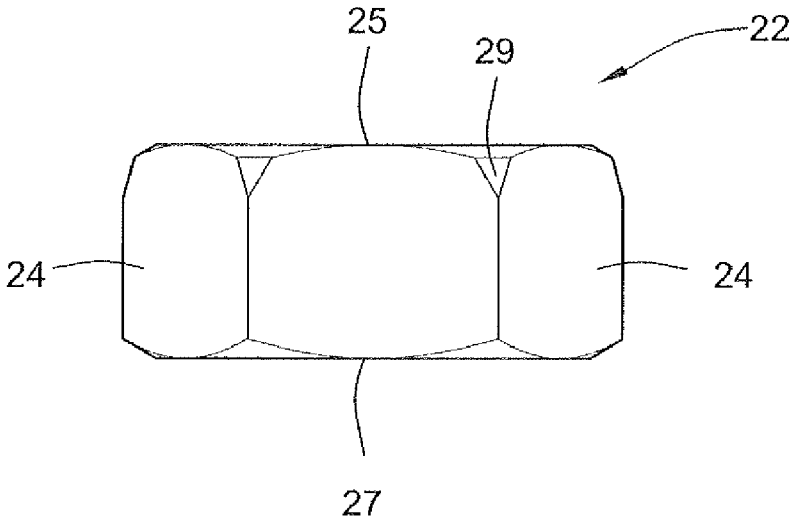
FIG. 9 is a side elevational view of the nut of FIG. 8.

A driver 20 is provided for manually rotatably driving an associated rotatable threaded fastening member 22, such as a conventional hexagonal nut, which is shown in FIG. 8. The fastening member 22 includes a plurality of faces 24 and an internally threaded bore 26 extending axially between opposed parallel end faces 25, 27. The faces 24 are flat and do not taper from one end face 25 to the other end face 27. The fastening member 22 is adapted for threaded engagement with the shank of an associated screw or bolt (not shown). While a nut is illustrated in the drawings in connection with the driver 20, it will be appreciated that the driver 20 could also be used for driving a headed fastener. A chamfer 29 may be provided at the corner between the faces 24 and the respective end faces 25, 27.

The driver 20 includes an elongated shank 28 which has a socket 30 at a front end of the shank 28. As shown, the shank 28 and socket 30 are integrally formed of metal. If desired, the socket 30 can be formed separately from the shank 28 and fixedly secured thereto by suitable means. A rear end of the shank 28 is attached to a handle 32. The handle 32 may be formed of metal and plastic or any other suitable materials.

The handle 32 is known in the art and has an exterior surface with a plurality of flats 34 thereon which the user can use to grip the handle 32. A blind bore 36 is provided in a front end of the handle 32 and extends rearwardly a predetermined amount. The blind bore 36 terminates at a wall 38.

The shank 28 has an external surface defined by an outer wall which is preferably cylindrical in shape. A first portion 40 of the shank 28 extends from the socket 30 to a second portion 42 of the shank 28. The second portion 42 has an exterior dimension which is larger than the first portion 40. In use, the second portion 42 is inserted into the blind bore 36 in the handle 32 and attached thereto by known means. The rear face 44 of the shank 28 preferably abuts against the wall 38 within the handle 32.

The socket 30 has an outer wall 43 which has an outer dimension that is greater than the outer dimension of outer wall of the shank 28. The outer wall 43 is preferably cylindrically shaped. A chamfer 45 may be provided at the corner between a front face 47 of the socket 30 and the outer wall 43. An angled wall 46 of the socket 30 connects the outer wall 43 to the outer wall of the shank 28.

A bore 48, which is defined by an internal wall, extends through the shank 28 and the socket 30 such that the bore 48 extends from the front face 47 to the rear end face of the shank 28. In the socket 30, the bore 48 defines a receptacle 50 for the fastening member 22. The receptacle 50 includes a front portion 52 which extends from the front face 47 of the socket 30 rearwardly a predetermined distance, a middle portion 54 which extends from the rear of the front portion 50 a rearwardly predetermined distance, a transition portion 56 which extends rearwardly from the rear of the middle portion 54 to a rear portion 58.

The front portion 52 extends 360° within the receptacle 50. The front portion 52 is dimensioned such that the front portion 52 is larger than the outer dimension of the associated fastening member 22. The front portion 52 can take a variety of shapes, such as a hexagon such that a plurality of flats are provided as the wall which forms the front portion 52, the flats being parallel to a centerline 55 of the driver 20, or a series of flutes and intersecting surfaces such as those disclosed in U.S. Pat. No. 3,495,485 which disclosure is herein incorporated by reference, the flutes and intersecting surfaces disclosed in U.S. Pat. No. 3,495,485 being parallel to the centerline 55. With either of these shapes for the front portion 52 and the middle portion 54, the receptacle 50 is compatible with a standard hexagonal nut. While, in the illustrated embodiment, the front portion 52 are hexagonal in shape for accommodating a standard hexagonal nut, it will be appreciated that the front portion 52 could be shaped to accommodate any other shape of the fastening member.

The tapered middle portion 54 extends uninterrupted 360° within the receptacle 50. The tapered middle portion 54 is spaced from the front face 47 by the front portion 52. The middle portion 54 continuously tapers inwardly toward the centerline 55 of the driver 20. The angle at which the middle portion 54 tapers is slight, preferably 2.5 degrees relative to the centerline 55. The middle portion 54 has a dimension which is largest at the end joined with the front portion 52 and a dimension which is smallest at the end joined with the transition portion 56. The smallest dimension of the middle portion 54 is less than the outer dimension of the associated fastening member 22 such that the fastening member 22 cannot pass through the receptacle 50. The middle portion 54 is preferably formed as a hexagon such that a plurality of flats are provided as the wall which forms the middle portion 54.

The front portion 52 extends for only a short distance, for example 0.065 inches. The tapered portion 54 extends for a much greater distance, for example 0.39 inches.

The transition portion 56 is frusto-conical in shape. The rear portion 58 is preferably cylindrical and is parallel to the centerline 55. The rear portion 58 has a dimension which is smaller than the smallest dimension of the front portion 52. The rear portion 58 transitions into the portion of the bore 48 which extends through the shank 28, and the rear portion 58 and the portion of the bore 48 which extends through the shank 28 are preferably cylindrical in shape.

The tapered middle portion 54 provides for locking the fastening member 22 in the socket 30 by a taper lock. The "lock" is caused by friction between the tapered middle portion 54 and the fastening member 22. Because the receptacle 50 has a slight taper and the faces 24 of the fastening member 22 are not tapered, the frictional "lock" is only generated along points of line contact (i.e., a hexagon) between the tapered middle portion 54 and the fastening member 22. The amount of friction generated is sufficient to hold the fastening member 22 in place, while still allowing the fastening member 22 to be removed from the receptacle 50 with minimal effort. Because the tapered middle portion 54 provides for locking the fastening member 22 in the receptacle 50, the need for a magnet as provided in the prior art is eliminated. As a result, the cost of the driver 20 is reduced since these additional components are not needed, and this simplifies manufacturing. The driver 20 can be formed by cold forging, and the tapered middle portion 54 can be easily added during the forging operation. In fact, providing the tapered middle portion 54 during the forging operation provides an advantage in that it is easier to strip the socket 30 from the punch during forming.

During insertion of the fastening member 22 into the socket 30, the fastening member 22 does not contact the entire circumference of the front portion 52 (and may not contact any of the front portion 52 depending on how the fastening member 22 is inserted and the exact geometry of the front portion 52) as the fastening member 22 is dimensionally smaller than the front portion 52. The fastening member 22 and the socket 30 are engaged together at the points of line contact between the tapered middle portion 54 and the faces 24 of the fastening member 22. The front portion 52 acts a spacer to situate the tapered middle portion 54 further back in the socket 30, thereby allowing for the conventional fastening member 22 to be more fully inserted into the socket 30 prior to engagement with the tapered middle portion 54 so that more (or all) of the fastening member 22 is seated within the socket 30. In addition, this provides a distinct advantage over the nut driver of U.S. Pat. No. 6,045,311 if a user attempted to use a conventional nut therein. Since the walls which form the receptacle are tapered from the end face of the socket, if a conventional nut were to be inserted therein, the nut would be stopped from entering further into the receptacle as soon as the corners of the nut engage the tapered wall. For a nut that is larger, the nut may not be able to inserted to any appreciable extent into the receptacle of U.S. Pat. No. 6,045,311.

In operation, the fastening member 22 is inserted into the receptacle 50 with the socket 30 facing up and gravity causes the fastening member 22 to slide down into the socket 30 and engage the taper of the tapered middle portion 54 to create the lock. The fastening member 22 continuously contacts the tapered middle portion 54. The user then taps the handle 32 down onto a solid surface with the socket 30 still in the up position. This causes a dynamic force from the mass of the fastening member 22 times the acceleration/deceleration, thereby wedging the fastening member 22 into place, "locking" the fastening member 22 so that the fastening member 22 will not disengage from the driver 20 regardless of the driver 20 orientation. The user then grasps the handle 32 and rotates the driver 20 to rotate the fastening member 22. To remove the fastening member 22, the process is reversed by tapping the socket 30 down onto a hard surface to remove the fastening member 22.

All drivers, such as hex socket wrenches, have a small amount of clearance built into the design to ensure that all fasteners of the correct nominal size will always fit. The clearance amount is dictated by ASME standards for both the socket and fastener sizes/tolerances. The clearance amount increases with the nominal fastener size, but is typically on the order of only a few thousandths of an inch. Therefore, a small amount of relative rotation between the socket 30 and the fastening member 22 occurs during usage up to the point where the corners of the fastening member 22 contact the front portion 52 along the lines of contact that are parallel to the rotational axis of the socket 30 and the fastening member 22.

The dimensions of the front portion 52 are dictated by the ASME standard. The depth of the front portion 52 is sized such that a fastening member 22 at the maximum allowable size and thickness will fit into the socket 30 of minimum size without extending outwardly from the end of the socket 30. The overall length of the front portion 52 plus the middle portion 54 is determined by the minimum size of the fastening member 22 that will be "held" by a socket 30 of maximum size. In other words, the fastening member 22 cannot fall to the bottom of the socket 30 without contacting the tapered middle portion 54.

Most fastening members 22 have a chamfer 29 around the perimeter of both sides thereof, breaking the sharp edges that would otherwise be present. Unlike a standard socket, a fastening member 22 inserted into the socket 30 will start out with point and/or line contact around the perimeter of one side of the fastening member 22. With the chamfer 29 present, the contact is reduced to six points at the midpoint of each edge around the perimeter. Without a chamfer 29, the contact will be along the six edges of the perimeter.

Friction is sufficient to transfer very low torques to the fastening member 22 held in the socket 30 as a result of the points of contact. However, as the torque increases, the fastening member 22 will start to rotate relative to the socket 30. Applicant believes that the rotation happens either because the friction is insufficient to prevent sliding of the contact surfaces or else the contact points are being deformed providing greater contact area, which in turn transfers more torque. Either way, at some point, the relative rotation becomes great enough that the corners of the fastening member 22 contact the walls of the front portion 52 and form lines of contact. This is similar to the way that torque is transferred in a normal socket with the exception that the length of the lines are shorter due to the shorter depth of the front portion 52. Applicant has verified through testing that the socket 30 is capable of exceeding the ASME proof torques by greater than 30% without damage to the fastening member 22.

While a preferred embodiment of the present invention is shown and described, it is envisioned that those skilled in the art may devise various modifications of the present invention without departing from the spirit and scope of the appended claims.

The invention claimed is:

1. A combination of a driver and a fastening member, said driver capable of manually rotatably driving said fastening member, said combination comprising:

said fastening member having an outer dimension; and said driver comprising an elongated shank having a front end and a rear end, said shank defining a centerline;

a handle provided at said rear end of said shank, and a socket provided at said front end of said shank, said socket having a receptacle therein for receiving said fastening member, said receptacle including a front portion extending from a front face of the socket rearwardly a predetermined distance toward said shank and a tapered portion extending from a rear of said front portion a predetermined distance toward said shank, said front portion being dimensioned such that said front portion is larger than the outer dimension of said fastening member and is formed from a plurality of walls which are parallel to said centerline, and said tapered portion tapering inwardly from said front portion toward said centerline such that a largest dimension of said tapered portion is joined with said front portion and a smallest dimension of said tapered portion is spaced from said front portion, said smallest dimension of said tapered portion being less than the outer dimension of said fastening member, said tapered portion extending uninterrupted 360° around said receptacle such that a rear edge of said fastening member continuously contacts the tapered portion when inserted therein.

2. The combination as defined in claim 1, wherein said fastening member has a plurality of faces and an internally threaded bore extending axially between opposed parallel end faces, each of said plurality of faces being flat such that each of said plurality of faces does not taper from one end face to the other end face.

3. The combination as defined in claim 2, wherein said tapered portion tapers at an angle that provides a frictional taper lock where said fastening member contacts the tapered portion.

4. The combination as defined in claim 2, wherein when said fastening member is inserted into said socket, said fastening member extends from said tapered portion to said front portion, and said front portion is dimensioned such that when a torque is applied to drive said fastening member, relative rotation between said fastening member and said socket forms lines of contact between said front portion and said fastening member.

5. The combination as defined in claim 1, wherein said tapered portion tapers at an angle of 2.5 degrees relative to said centerline.

6. The combination as defined in claim 5, wherein said fastening member has a plurality of faces and an internally threaded bore extending axially between opposed parallel end faces, each of said plurality of faces being flat such that each of said plurality of faces does not taper from one end face to the other end face.

7. The combination as defined in claim 6, wherein said tapered portion tapers at an angle that provides a frictional taper lock where said fastening member contacts the tapered portion.

8. The combination as defined in claim 6, wherein when said fastening member is inserted into said socket, said fastening member extends from said tapered portion to said front portion, and said front portion is dimensioned such that when a torque is applied to drive said fastening member, relative rotation between said fastening member and said socket forms lines of contact between said front portion and said fastening member.

9. The combination driver as defined in claim 1, wherein said front portion and ends of said tapered portion are formed as hexagons.

10. The combination as defined in claim 9, wherein said fastening member has a plurality of faces and an internally threaded bore extending axially between opposed parallel end faces, each of said plurality of faces being flat such that each of said plurality of faces does not taper from one end face to the other end face.

11. The combination as defined in claim 10, wherein said tapered portion tapers at an angle that provides a frictional taper lock where said fastening member contacts the tapered portion.

12. The combination as defined in claim 10, wherein when said fastening member is inserted into said socket, said fastening member extends from said tapered portion to said front portion, and said front portion is dimensioned such that when a torque is applied to drive said fastening member, relative rotation between said fastening member and said socket forms lines of contact between said front portion and said fastening member.

13. The combination as defined in claim 1, wherein said receptacle further includes a frusto-conical portion extending from a rear of said tapered portion a predetermined distance, and a rear portion extending from a rear of said frusto-conical portion.

14. The combination as defined in claim 1, wherein said shank and said socket are integrally formed of metal.

15. The combination as defined in claim 1, wherein said shank and said socket are formed of metal.

16. The combination as defined in claim 1, wherein said handle has an exterior surface with a plurality of flats thereon.

17. A method comprising:

providing a fastening member having an outer dimension, a front edge and a rear edge;

providing a driver including an elongated shank having a front end and a rear end, said shank defining a centerline, a handle provided at said rear end of said shank, a socket provided at said front end of said shank, said socket having a receptacle therein for receiving said fastening member, said receptacle including a front portion extending from a front face of the socket rearwardly a predetermined distance toward said shank and a tapered portion extending from a rear of said front portion a predetermined distance toward said shank, said front portion being dimensioned such that said front portion is larger than the outer dimension of said fastening member and is formed from a plurality of walls which are parallel to said centerline, and said tapered portion tapering inwardly from said front portion toward said centerline such that a largest dimension of said tapered portion is joined with said front portion and a smallest dimension of said tapered portion is spaced from said front portion, said tapered portion extending uninterrupted 360° around said receptacle;

inserting said fastening member within said receptacle such that said rear edge of said fastening member moves past said front portion until said rear edge of said fastening member continuously contacts the tapered portion; and grasping said handle to rotate said driver.

18. A method as defined in claim 17, wherein during inserting the fastening member within said receptacle, said socket is faced up and gravity causes the fastening member to slide down into the socket and engage the tapered portion.

19. A method as defined in claim 18, wherein after inserting the fastening member the handle is tapped onto a solid surface with the socket still facing up.

20. A method as defined in claim 17, further comprising applying a torque to said driver so as to rotate said fastening member relative to said socket to form lines of contact between said front portion and said fastening member.

* * * * *